United States Patent [19]

Peart et al.

[11] Patent Number: 4,541,340

[45] Date of Patent: Sep. 17, 1985

[54] PROCESS FOR FORMING PERMANENT IMAGES USING CARRIER SUPPORTED INKS CONTAINING SUBLIMABLE DYES

[75] Inventors: Whitcomb S. Peart, Keene; Jon O. Baldvins, Nashua, both of N.H.

[73] Assignee: Markem Corporation, Keene, N.H.

[21] Appl. No.: 644,668

[22] Filed: Aug. 28, 1984

Related U.S. Application Data

[63] Continuation of Ser. No. 394,877, Jul. 2, 1982, abandoned.

[51] Int. Cl.[4] ..... B41M 5/02

[52] U.S. Cl. ..... 101/470; 8/471; 101/426; 101/32; 400/241.1

[58] Field of Search ..... 8/471; 101/470, 32, 101/426; 400/241.4

[56] References Cited

U.S. PATENT DOCUMENTS

| | | | |
|---|---|---|---|
| 702,693 | 6/1902 | Bartle | 101/468 |
| 791,503 | 6/1905 | Roehm | 101/426 |
| 1,063,791 | 6/1913 | Henington | 101/470 |
| 1,853,654 | 4/1932 | Belokopytoff | 101/468 |
| 2,830,689 | 4/1958 | Clancy | 400/241.4 |
| 3,170,395 | 2/1965 | Gundlach | 101/470 |
| 3,245,796 | 4/1966 | Burg | 101/473 |
| 3,357,353 | 12/1967 | Teuscher | 101/470 |
| 3,408,216 | 10/1968 | Mott | 101/470 |
| 3,441,425 | 4/1969 | Richlin | 400/241.4 |
| 3,464,779 | 9/1969 | Collez | 101/470 |
| 3,476,937 | 11/1969 | Vrancken | 101/470 |
| 3,508,492 | 4/1970 | Seibert | 101/470 |
| 3,669,019 | 6/1972 | Barouh | 101/470 |
| 3,722,406 | 3/1973 | Strong | 8/2.5 A |
| 3,860,388 | 1/1975 | Haigh | 101/467 |
| 3,927,237 | 12/1975 | Sund | 101/470 |
| 4,003,698 | 1/1977 | Snyder | 8/2.5 A |
| 4,059,471 | 11/1977 | Haigh | 101/470 |
| 4,063,878 | 12/1977 | Weeks | 101/470 |
| 4,284,456 | 8/1981 | Hare | 101/470 |
| 4,357,189 | 11/1982 | Buckwalter | 8/472 |

FOREIGN PATENT DOCUMENTS

| | | | |
|---|---|---|---|
| 1135929 | 9/1962 | Fed. Rep. of Germany | 101/467 |
| 2312418 | 9/1973 | Fed. Rep. of Germany | 8/2.5 A |
| 2062085 | 6/1971 | France | 101/470 |
| 133908 | 10/1979 | Japan | 101/170 |
| 56295 | 4/1982 | Japan | 8/470 |
| 63258 | 4/1982 | Japan | 101/470 |
| 102390 | 6/1982 | Japan | 101/468 |
| 1567901 | 5/1980 | United Kingdom | 101/170 |

*Primary Examiner*—Clyde I. Coughenour
*Attorney, Agent, or Firm*—Robbins & Laramie

[57] ABSTRACT

A process for forming a permanent, abrasion and chemical resistant image on a fabric or plastic substrate is disclosed which comprises (a) providing a printing matrix having raised portions in the shape of the image to be printed on the substrate, (b) providing a carrier supported ink comprising (1) a uniform coating of an ink composition comprising a sublimable dye, (2) a carrier sheet for supporting said coating on one surface thereof, (c) disposing the carrier supported ink adjacent to the printing matrix such that the uncoated surface of the carrier sheet faces the printing matrix, (d) providing a fabric or plastic film substrate having a surface into which said sublimable dye can diffuse, (e) disposing the substrate such that the surface thereof faces the coated surface of the carrier sheet, (f) applying pressure between said printing matrix and said substrate to cause the printing matrix to contact the uncoated surface of the carrier sheet and the coated surface of the carrier sheet to contact the substrate surface, said pressure being applied under conditions sufficient to cause the ink composition to completely transfer from the carrier sheet to the substrate surface in the shape of the image defined by the raised portions of the printing matrix, but insufficient to cause the dye in the ink composition to sublime or vaporize, and (g) heating the ink composition which has been transferred to the substrate surface, and heating occurring under conditions sufficient to cause the dye therein to sublime or vaporize and then diffuse into the substrate surface.

29 Claims, 3 Drawing Figures

PROCESS FOR FORMING PERMANENT IMAGES USING CARRIER SUPPORTED INKS CONTAINING SUBLIMABLE DYES

This application is a continuation of application Ser. No. 394,877, filed July 2, 1982, now abandoned.

BACKGROUND OF THE INVENTION

1. Field of the Invention

This invention relates to carrier supported inks which contain sublimable dyes and to a process and apparatus for printing fabric or plastic film substrates with such carrier supported inks to render the images printed on the substrates abrasion and chemical resistant.

The invention is particularly suitable for use in preparing printed fabric or plastic film labels which can be subjected to corrosive laundering conditions or highly abrasive conditions without effacing their legibility.

2. Description of the Prior Art

Prior to the present invention, printed fabric labels were made using a variety of well-known techniques, such as screen printing, offset lithography printing, dyeing, flexographic printing, and in-plant printing.

Screen printing, also known as silk screen, employs a porous stencil mounted on a screen, in which the non-printing areas are protected by the stencil. Printing is done on a mechanized press by feeding the cloth under the screen, applying ink with a paint-like consistency to the screen, and spreading and forcing it through the fine mesh openings with a squeegee.

In the offset lithography method, the image and non-image areas are essentially on the same plane of the surface of a thin metal plate, the definition between them being maintained chemically. The ink is picked up by the hydrophobic areas on the plate but is not picked up by the hydrophilic areas. The image is then transferred to an offset rubber roll, then from the roll to the fabric sheet.

Flexographic printing is a form of rotary letterpress using flexible rubber plates and fast-drying fluid inks. The rubber plates utilize the relief method for image creation, where the image area is raised above the non-image areas. Ink rollers touch only the top surface of the raised area. The surrounding, non-printing, areas are lower and do not receive ink. The inked image is transferred directly to the cloth. Dyeing can be achieved by using dyestuffs rather than pigmented inks in any of the printing processes described above. The use of dyes, however, requires additional after treatments to fix the dye in the fabric.

All of these methods lend themselves to use on large scale commercial printing equipment in which large sheets or webs of fabric are printed, and then cut or slit into strips for fabric labels. These labels are suitable for use in garments for the purpose of decoration, identification, advertising, wash and care instructions, size, price, as well as other purposes.

However, there are economic disadvantages to labels produced by these large commercial methods. Purchasers of labels must buy large minimum quantities of a particular type of label to maximize economies of scale. Therefore, due to the large number of possible combinations of colors, size, fabric content, etc. for a particular garment and minimum order requirements, a large inventory of labels must be maintained to ensure that each garment receives the proper labelling which is required. In addition to the obvious costs of maintaining an excess inventory, there are costs of label obsolescence. Moreover, an insufficient inventory results in improperly labeled garments which many times cannot be used until they are labeled properly. This often results in manufacturing or garment processing facilities which must shut down until proper labels can be obtained.

These disadvantages have led to the widespread use of in-plant printing systems which allow label users to print labels, as required, in direct response to their manufacturing needs. The main advantage of in-plant printing systems is that label changes can be made quickly, eliminating the need for large inventories of pre-printed labels, with subsequent economic advantages. Early methods of in-plant printing systems utilized small versions of flexographic or similar printing systems using a fluid or paste ink. An example of the type of system which can be used to print fabric labels with an indelible ink is disclosed in U.S. Pat. No. 3,733,212. In this system, a fabric label made of polyester or of a polyester/-cotton blend and having a thermoplastic adhesive layer is printed with a liquid ink which contains a water dispersed dye capable of indelibly dyeing the fibers of the fabric when heated to an elevated temperature.

Although these in-plant printing systems are still in use today, they have in large part been supplanted by hot stamping in-plant printing technology which utilizes carrier supported ink. A carrier supported ink, often referred to as a hot stamping foil, comprises a dry ink coating on one side of a carrier sheet. Examples of carrier supported inks can be found in U.S. Pat. Nos. 3,441,425 and 4,251,276. The printed image is created when metal relief type or characters on a printing plate are brought into intimate contact with the uncoated side of the carrier. The coated side is simultaneously brought into intimate contact with the appropriate fabric under pressure and/or heat. Upon removal of the printing element or plate from the carrier, the carrier supported ink is pulled away from the fabric, leaving the image on the fabric where the top areas of the raised printing elements came into contact with the carrier. The advantages of this method over in-plant ink printing systems are that there is no ink to spill or clean up, the print opacity and contrast is superior, and the print quality is more controlled since the ink coating is of uniform thickness. All of the above methods provide textile and garment manufacturers with labels of high print quality and durability under most requirements of washability and dry cleaning.

However, one segment of the garment industry, industrial uniform manufacturers and laundry services, has been provided with high quality, durable printed fabric labels only from large scale commercial printing houses, and not from in-plant printing systems. Industrial uniforms are subjected to extremely corrosive and abrasive laundering conditions which destroy the legibility of ordinary fabric labels. Therefore, preprinted dyed labels, where the image is actually fixed into the fabric of the label, and preprinted labels with cured or thermoplastic overcoatings are required to maintain legibility. Industrial uniform manufacturers require print legibility for advertising purposes and to allow the garment user to maintain size integrity of his garments after each industrial laundering. If the garment size on the label becomes illegible, the garment cannot be classified properly according to size. Industrial uniform services have observed that unless label legibility is maintained, a high percentage of uniforms are lost, stolen, or misplaced during the laundering process.

Thus, the industrial garment industry is forced into using only preprinted labels during the manufacture and laundering processes, despite their large inventory requirements and obsolescence costs because the most practical, economic, and versatile labels printed with carrier supported ink in-plant printing technology do not survive repeated industrial launderings.

Textiles have been printed with designs for many years using a technique referred to as transfer printing. In an early version of this technique known as wet transfer printing, a paper carrier sheet was printed with a design using a gravure printing technique with a wide variety of dye classes, such as vat, acid and direct dyes, and acetate dispersed dyestuffs. The printing inks contained thermoplastic components. When the printed paper was brought in contact with the fabric, transfer of the print from the paper to the fabric was effected by applying heat and pressure. The prints on the fabric were then treated with steam to set the dyestuffs followed by washing to remove thickeners. Such aftertreatments are those employed in conventional techniques for dyeing fabrics. An example of this type of transfer printing is shown in U.S. Pat. No. 2,911,280.

Another technique for transfer printing is referred to as thermacrome or melt transfer printing. In this technique, a design is printed onto a carrier paper with a thermoplastic resin containing a pigment. To effect transfer of the printed design to a fabric, the printed paper is heated in contact with the fabric whereupon the resin melts and is partially transferred to the fabric substrate. Such prints do not require an aftertreatment. Variations of this technique are often referred to as decalcomania. U.S. Pat. Nos. 4,037,008 and 4,038,123 are exemplary.

A third type of transfer printing technique is known as dry transfer, sublimation transfer or vapor phase transfer. Using this technique, a heat resistant carrier such as paper is printed with inks containing sublimable dyestuffs. The printed paper is then placed in contact with the fabric surface. When heat and pressure are applied to the back of the paper, the dyes sublime from the ink on the paper, diffuse across the air gap to the surface of the fibers in the fabric, condense on the fibers and then diffuse into the interiors of the fibers. Since not all of the dye sublimes during one application, the transfer paper can often be used a number of times to transfer the same design. This third type of transfer printing has become the most widely accepted of these methods for printing fabrics with designs. Numerous examples of this type of transfer printing can be found in U.S. Pat. Nos. 3,363,557, 3,484,342, 3,707,346, 3,813,216, 3,888,623, 3,969,071, 4,021,591, 4,058,644, 4,171,202, 4,171,230, 4,205,991 and 4,278,434. This technique can also be used to dye substrates other than fabric as shown in U.S. Pat. Nos. 3,239,366, 3,508,492 and 4,059,471.

In dry transfer printing, designs are printed using a variety of techniques such as letterpress, flexographic, gravure, rotary screen or offset lithography. The carrier onto which the designs are printed must be a sheet of a heat resistant material. Paper or metal foils are the preferred carriers used in virtually all applications because they are heat resistant at the temperatures between about 150° F. and 500° F., and generally between about 350° F. and 450° F., and for the periods of time from a few seconds to a few minutes required to vaporize the sublimable dyestuff in the ink. All other carrier materials which are not heat resistant, such as plastic films, would become deformed or destroyed or would be dyed themselves at such elevated temperatures. The inks containing the sublimable dyes also contain resins and other binder components such as surface active agents and viscosity modifiers. These binder components function to hold the dyestuff onto the paper carrier and remain on the carrier following sublimation of the dyestuff. Therefore, these binder components cannot interfere with the partial sublimation and transfer of the vaporized dyestuff from the ink to the fabric surface, nor can they contain any wax or other meltable or thermoplastic components which would interfere with the transfer process. Under the application of heat and pressure, these meltable components would smear from one surface to the other producing a diffused or discontinuous image caused by a spreading of the ink.

Transfer printing techniques are as unsuitable as the other large scale commercial printing methods for printing directly on fabric labels. The transfer papers must first be printed with the characters or design which is to be transferred to the labels. Preprinting is usually done off site in large volume to be economic. In order to ensure that each garment will receive the proper labelling which is required, a large inventory of different labels must be maintained. If the printing were to be done in-plant, an equally large inventory of different preprinted transfer papers would be required. Moreover, the printing rollers are very expensive and slow to produce.

As described above, the most economical and efficient method of in-plant printing involves hot stamping technology utilizing carrier supported inks. Fabric labels printed using carrier supported inks cannot withstand extremely corrosive and abrasive laundering conditions to the same degree as labels in which the fabric has been dyed. Transfer papers, such as those employed in dry transfer printing techniques to dye fabric with preprinted designs, however, could not be employed in hot stamping printing systems that presently employ carrier supported inks. Because transfer papers must be sufficiently heat resistant to withstand the relatively high temperatures and long dwell times required to vaporize the dyestuffs printed on the papers to cause them to transfer to the fabric substrates, they simply would be inoperative in hot stamping equipment in which the printing elements are at lower temperatures and the dwell times are very short. The heat resistant paper would prevent the dyestuff from reaching its sublimation temperature and transferring to the fabric substrate. Moreover, the ink formulation used to print transfer papers is designed to remain on the paper during sublimation and transfer of the dyestuff to the fabric and therefore, would be inoperative under the conditions employed in hot stamping equipment. If a transfer paper were to be made with a less heat resistant carrier material, then the temperatures and dwell times required to vaporize and transfer the dyestuff would destroy or deform the carrier and cause a poor image to be transferred to the fabric substrate.

SUMMARY OF THE INVENTION

In accordance with the present invention, carrier supported inks containing sublimable dyes are prepared which can be used in an in-plant printing system for printing fabric labels and which do not exhibit the limitations and drawbacks of the prior art systems. The carrier supported inks of the present invention are prepared by uniformly coating a carrier sheet with a discontinuous layer of an ink composition containing a sublimable dye.

The carrier sheets which can be employed in the practice of this invention are made of materials which are compatible with the ink compositions to be coated on their surfaces. The carrier should have a thickness and thermal conductivity that will permit it to conform to the raised portions of the printing matrix and to readily transmit the heat and/or pressure from the stamping equipment in which it is employed to the ink coating without being destroyed. The surface of the carrier should be smooth and sufficiently compatible with the ink composition so that the ink will uniformly coat the carrier and will not crack or flake at room temperature, but will permit complete transfer of the ink when subjected to the heat and/or pressure of the stamping operation.

The ink composition for coating the carrier comprises a sublimable dye, a resin, a wax, and optionally, other conventional ink modifiers in amounts which will form a discontinuous film on the surface of the carrier upon drying. The ink composition should be compatible with the carrier so that it can uniformly coat the carrier, and should completely transfer from the carrier to the substrate to be printed upon application of heat and/or pressure.

In the process of the present invention, the carrier supported ink containing the sublimable dye is positioned in a stamping machine, such as is conventionally used for in-plant printing, between the printing matrix and the substrate to be printed, such as a fabric or plastic film, with the ink coated side of the carrier facing the substrate. Pressure is then applied between the printing matrix with a raised image and the substrate under conditions sufficient to cause the printing matrix to contact the uncoated surface of the carrier sheet and the coated surface to contact the substrate surface and to cause the ink composition on the carrier to be completely transferred to the surface of the substrate in the image defined by the raised portions of the printing matrix, but insufficient to cause the dye in the ink composition to sublime or vaporize. The ink composition which has been transferred to the substrate surface is then heated under conditions sufficient to cause the dye therein to sublime or vaporize and then diffuse into the substrate surface. Since the ink image becomes an integral part of the substrate material rather than merely being printed on its surface, the dyed image is permanent and cannot be abraded off or chemically removed from the surface.

Fabric labels printed according to the present process are corrosion and abrasion resistant and remain legible after repeated exposure to harsh industrial laundering conditions. Other substrates, such as plastic films, printed with the present process are likewise chemical and abrasion resistant making them suitable for many industrial and electronics identification applications.

DESCRIPTION OF THE PREFERRED EMBODIMENTS

Figure 1:
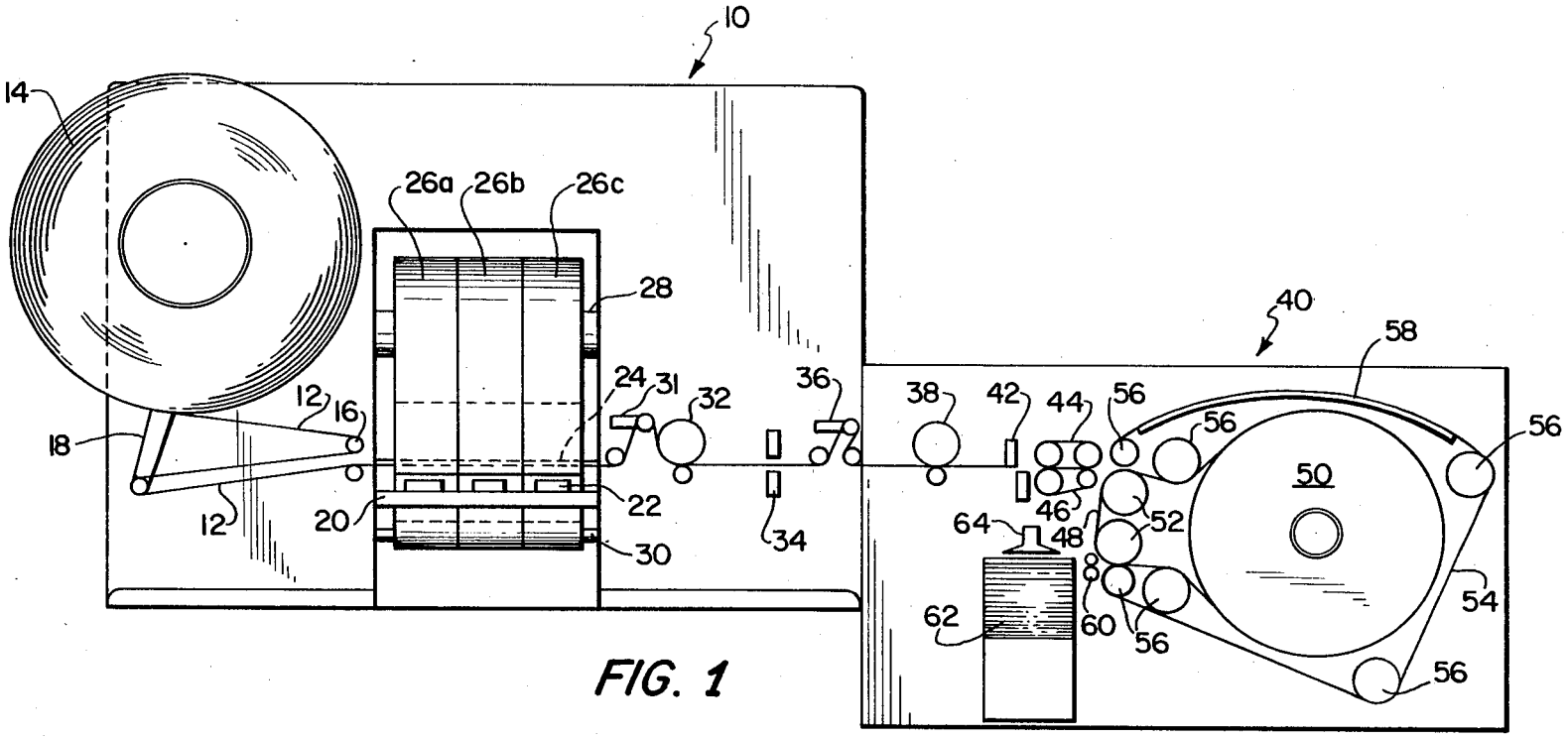
FIG. 1 is a plan view of an apparatus suitable for use in practicing the process of the present invention.

In accordance with the present invention, a carrier supported ink is prepared by uniformly coating one side of a carrier sheet with an ink composition comprising a sublimable dye, a resin, a wax, and optionally, other conventional ink modifiers. The ink coating is considered to be uniform when it entirely covers one surface of the carrier sheet and has a uniform thickness or coat weight.

Any web or film can be used as the carrier sheet provided that it is made of a material that is compatible with the ink composition to be coated on its surface. For the ink and the carrier to be compatible, the surface tension of the ink when molten should be less than the critical surface tension of the carrier for complete wetting by the ink when coating and for complete release of the ink during hot stamping. The carrier must have a thickness and a thermal conductivity which permits the carrier to conform to the raised portions on the printing matrix and further permits the heat and pressure applied to the back of the carrier by the hot printing matrix to be transmitted to and melt or soften the ink composition without destroying the carrier, so that the coating will completely release from the carrier in the shape of the image defined by the raised portions of the printing matrix. Suitable carriers can be made from low or high density polyethylene, low or high density polypropylene, polyester, polyamide, or from other oriented or biaxial thermoplastic films as well as from cellophane films, thermoset films or coated papers, such as glassine, which are sufficiently thin to transmit the heat and pressure to melt or soften the ink composition and to conform to the raised portions of the printing matrix. Preferably, the carrier sheet is a thermoplastic film which is not resistant to the conditions of temperature, pressure and time required to sublime the dye into the substrate. The paper sheets used in the prior art for transfer papers are not suitable for use in the practice of this invention because they are heat resistant and absorb ink printed thereon, preventing it from being completely released. The carrier sheet is preferably smooth to permit uniform coating by the ink composition. The thickness of the carrier sheet is generally from about 0.25 mil to 2.5 mils, and preferably from about 0.5 mil to 1.5 mils.

The sublimable dye which is used in the ink composition can be any dyestuff or mixture of dyestuffs which sublime or vaporize or otherwise convert to a mobile phase at a temperature above about 140° C. (284° F.), and preferably between about 160° C. (320° F.) and about 205° C. (401° F.), at atmospheric pressure. Dyestuffs with sublimation temperatures below 140° C. can be used, but are not as suitable because of their tendency to resublime on washing or ironing, thereby lowering the fastness of the image below those desired in industry. Suitable dyestuffs can include any of the recognized classes of disperse dyestuffs, such as the nitroso, nitro, monoazo, disazo, trisazo, polyazo, stillbene, carotenoid, diphenylmethane, triarylmethane, xanthene, acridine, quinoline, methine, thiazole, indamine, indophenol, azine, oxazine, thiazine, sulphur, lactone, aminoketone, hydroxyketone, anthraquinone, indigoid, phthalocyanine, and quinonaphthalone dyes, such as are commercially available or are described in, for example, the third edition of the Colour Index which was published in 1971. Such dyestuffs are normally the commercially available forms containing considerable amounts of dispersing agents and/or other diluents, but the corresponding pure dyestuffs (i.e. free from dispersing agents and/or diluents) can also be used. Commercially available disperse dyes include the "Foron" dyes from Sandoz Colors & Chemicals, the "Samaron" dyes from American Hoechst, the "Amercron" dyes from American Dye & Color Co., the "Artisil" dyes from Sandoz, as well as certain "Nitrofast" oil soluble dyes from Sandoz. Suitable sublimable dyestuffs include, for example, those specifically enumerated in U.S. Pat. Nos. 4,205,991, 4,171,202 and 3,707,346, incorporated by reference as though set forth in full herein. However, any sublimable dyestuff can be employed in the practice of the present invention provided that it does not sublime under the conditions of temperature and pressure employed in the hot stamping of the carrier supported ink. The amount of sublimable dye in the ink composition can range from about 2 to about 91 percent by weight based on the total weight of the ink composition, the amount of dye actually used depending upon the intensity of the color desired in the printed substrate. The amount of solvent employed in the ink depends on the amount of dyestuff desired. If the dye level is high then the solution preferably will have a lower solids content, and if a low dye level is used, then the solution will preferably contain a higher solids content. The solids content is used to adjust the thickness of the coating of wet ink applied to the carrier. If the ink coating on the carrier is too heavy, then too much unfixed dyestuff will remain on the surface of the substrate and result in crocking of the print if rubbed prior to washing.

The resin component of the ink composition functions as a binder for the other components. The cohesion of the ink coating and its adhesion to the carrier surface are dependent on the type and amount of resin employed. The ink coating composition will generally comprise from about 2 to about 67 percent by weight of the resin. As the amount of resin is increased, the adhesion to the carrier is increased and the percentage of transfer of the ink from the carrier to the substrate will decrease. The resin is selected so that it will adequately bind the ink coating to the carrier without flaking prior to hot stamping, it will permit complete transfer of the ink coating during hot stamping, and it will bind the ink to the substrate but will not hinder sublimation of the dyestuff from the ink composition into the substrate during subsequent application of heat and/or pressure to the printed substrate. The resins can be mixed into the ink composition in the form of emulsions or solutions. Suitable resins include, for example, nitrocellulose, ethyl cellulose, methyl cellulose, carboxy methyl cellulose, phenolic, acrylic, polyurethane, rosin and rosin esters, epoxy, epoxy esters, polyvinyl alcohol, polyvinyl acetate, polyvinyl chloride, and polyester resins.

Since the resin is only employed as a temporary binder to hold the sublimable dye and other binder components first onto the carrier and then onto the surface of the substrate prior to sublimation of the dyestuff into the substrate, its chemical composition is not critical to the practice of the present invention. In fact, the amount of heat and pressure to which the printed substrate must be subjected to cause the dyestuff to sublime and diffuse into the substrate may actually vaporize, decompose or otherwise dissipate the binder components. For this reason, it has been found that essentially all types of resins can be employed to provide the necessary adhesion and cohesion to the ink coating without hindering sublimation of the dyestuff, provided that they are used with the other components of the ink composition in the amounts indicated herein.

The ink composition also contains a wax to control the level of discontinuity and the release characteristics of the ink coating. The ink coating generally comprises from about 4 to about 45 percent by weight of the wax. As the level of wax increases, the discontinuity of the coating increases and the adhesion of the ink coating to the carrier decreases until at a high wax level the dry ink can be easily wiped off the surface of the carrier. The wax causes the ink film on the carrier to be discontinuous and smooth. In essence, the wax acts as a release agent to ensure complete transfer of the ink composition from the carrier to the substrate during hot stamping. Once printed on the substrate, however, the wax should not interfere with the sublimation of the dyestuff from the ink composition into the substrate. Suitable waxes, include animal waxes, such as spermaceti, beeswax, stearic acid and Chinese wax, vegetable waxes, such as carnauba, Japan, bayberry and candelilla, mineral waxes, such as ozocerite, montan, ceresin, and paraffin, synthetic waxes, such as polyethylene, polypropylene, polyethylene glycol, polyoxyethylene esters, chloronaphthalenes, sorbitols, chlorotrifluoroethylene resins, polytetrafluoroethylene, microcrystalline waxes, and mixtures thereof.

Optionally, the ink composition can contain small but effective amounts of conventional ink modifiers, such as defoamers, surfactants, dispersants, flow control agents, viscosity control agents, pH modifiers, and preservatives. These modifiers are generally employed in amounts which total less than about 10 percent by weight of the ink composition.

The wet ink composition will also contain a solvent for the resin. Examples of such solvents include toluene and other aromatics, methyl ethyl ketone, cellosolves, water, alcohols, chlorinated hydrocarbons, esters, and ethers.

The amounts of sublimable dye, resin, wax and optional ingredients are selected within the ranges given above so that the ink composition forms a discontinuous film on the surface of the carrier upon drying. This discontinuous film must completely release from the carrier surface in the shape of the image defined by the raised portions of the printing matrix during the hot stamping operation. The sublimable dyes employed in the practice of the present invention are often disperse dyes. As such, they do not dissolve in the ink composition, but rather, remain in solid particulate form. Similarly, the waxes are added to the ink compositions under conditions in which they do not melt, but remain discrete particles. Thus, the ink composition coated onto the carrier contains discrete particles of dye and wax surrounded by a resin binder, which, when dried, results in a coating on the carrier that is not a continuous film of a resin or of a homogeneous ink composition, but rather, is a discontinuous film of the resin binder surrounding the discrete particles of dye and wax.

During the hot stamping operation, the heated printing matrix having raised portions in the shape of the image to be printed on the substrate is brought into contact with the uncoated surface of the carrier under pressure. Under the application of heat and pressure, the carrier sheet conforms to the raised portions on the printing matrix stretching the carrier over the edges of the raised portions. The heat and pressure transmitted through the carrier sheet melts or softens the ink coating in the areas on the carrier corresponding to the raised portions of the printing matrix. Because the ink coating is discontinuous, it fractures along the edges of the area where the matrix contacts the substrate. Within the narrow limits of the fracture the coating remains discontinuous even though some softening of the wax closest to the matrix is possible. The coating between the matrix and the substrate becomes compressed and proportionally more continuous. The ink coating then releases from the carrier within the fracture lines and is transferred to the substrate in the shape of the image defined by the raised portions of the printing matrix. Since the coating completely transfers in those areas within the fracture lines, a sharp dense image is printed on the substrate surface.

The ink composition is preferably made by first thoroughly mixing the resin and solvent together in a high speed disperser such as a Morehouse-Cowles, an air driven propeller-type stirrer, or the like. The sublimable dye, wax, and optional modifiers are then added and thoroughly mixed with the other ingredients. After mixing, the ink composition is filtered through a 5 micron filter bag and then the pH, viscosity, surface tension, and solids content are checked. Preferably, the pH is in the range of about 6.5–9.0, the viscosity is in the range of 5–400 centipoises, and more preferably 20–100 centipoises, at 20° C., the surface tension is in the range of 20–50 dynes/cm, and preferably 30–45 dynes/cm, and the solids content is in the range of 20–40 percent. An excess of ink is then applied to the carrier film by an inking roll and metered off to the proper thickness by an air knife, Meyer bar or other appropriate means. The carrier is generally coated to a coat weight of 0.00032–0.00044 g/cm$^2$. The coated carrier is then passed through a heated drying tunnel, cooled and wound into rolls which are subsequently cut into a size that is suitable for use in hot stamping equipment.

In the process of the present invention, a carrier supported ink prepared in this manner is then used in a hot stamping machine to print an image on a substrate. The carrier supported ink is placed between the substrate to be printed and a heated matrix having raised portions in the shape of the image to be printed on the substrate. The coated surface of the carrier faces the substrate. Suitable substrates include fabrics such as polyester, nylon and acetate, and blends of these with cotton or wool, cotton or wool that have been treated to accept sublimable dye, plastic films, such as polyester and nylon, paper, and any other surface that treated or untreated will accept a sublimable dye. The substrate is then printed with the image on the matrix by applying sufficient heat and pressure to completely transfer the ink coating to the substrate without destroying the carrier. The matrix temperature can be in the range of about 52° C. (125° F.) to about 205° C. (401° F.), the pressure applied is in the range of about 100 psi to about 1000 psi, and the dwell time is in the range of about 0.1 second to about 1 second, i.e. a rate of about 50 to 200 per minute. It will be appreciated that the lower the temperature of the heated matrix is, the greater the dwell time and/or pressure must be to insure complete transfer.

When subjected to heat the ink composition begins to melt. As the ink melts the surface tension of the compound lowers until it approaches the critical surface tension of the carrier. When the critical surface tension of the carrier is exceeded, as an effect of the heating process, the pressure applied by the matrix causes transfer of the ink compound to the colder substrate material. The composition of the ink is such that it has a greater affinity for the substrate than the heated carrier due to the applied heat and pressure. This effect will selectively release the ink completely from the carrier where the matrix comes in contact with the carrier and substrate, thus affixing it to the substrate. It is important that the cohesive forces in the ink film be strong enough to transfer the complete ink compound from the carrier, but not so great as to prevent the clean separation of the ink film at the edges of the raised portions of the matrix at the moment the matrix contacts the carrier supported ink and substrate with heat and pressure.

The printing on the substrate is considered to be acceptable and the transfer to be complete only when at least 90 percent of the ink coating transfers to the substrate and sharp dense prints are produced on the substrate.

The printed substrate is then subjected to a source of heat to cause the dyestuff in the ink on the substrate to vaporize or sublime and to diffuse the dyestuff into the substrate. The ink can be subjected to any source of conductive, convective or radiant heat for a sufficient amount of time to heat the dyestuff above its sublimation temperature. If the ink is to be heated by conduction, pressure may be applied to maintain intimate contact between the substrate and the source of heat. Heat and pressure can be applied directly at a temperature in the range of about 140° C. (284° F.) to 224° C. (435° F.) for about 2 to 10 seconds. If the ink is to be heated by convection, a source of hot air at 205° C. (401° F.) to 371° C. (700° F.) has been found to be suitable. Suitable sources of radiant heat include infrared, laser, xenon flash, or other gas discharge lamps.

It has been found that fabric labels that have been printed in accordance with the process of this invention can withstand more than fifty industrial launderings simulated by a modified American Association of Textile Chemists and Colorists (AATCC) test method designed to reproduce the harshest industrial laundering conditions. AATCC test method 61-1980, test No. IVA is designed for evaluating the washfastness of textiles that may be laundered in the presence of available chlorine. Specimens subjected to this test should show color damage similar to that produced by five commercial launderings at 71° C. (160° F.) with 1.9 liters (2 quarts) of 1.0% available chlorine per 45.5 kg (100 lb) of load (white wash formula). The test is run in a Launder-Ometer available from Atlas Electric Devices Co. or similar apparatus for rotating closed containers in thermostatically controlled water bath at 42 rpm. The abrasive action is accomplished by the use of throw, slide, and impact, together with the use of a low liquor ratio and an appropriate number of steel balls. Test No. IVA calls for a bath temperature of 71° C. (160° F.), a total liquor volume of 50 ml. comprising 45 ml. of AATCC standard detergent WOB solution and 5 ml. of 0.15% available chlorine solution, buffered to a pH of 11, 0.2% detergent based on the total volume, the addition of 100 $\frac{1}{4}$ in. stainless steel balls in the container, at a wash time of 45 minutes.

Test No. IVA has been modified to more closely simulate the effects of harsh industrial launderings. Instead of the standard detergent solution with available chlorine, a 50 ml. solution is prepared using 32 g. of Ajax Industrial Cleanser with oxygen bleach, 7.5 g. of Twin Sol, a detergent with a hydrocarbon solution, available from Stauffer Chemical Company, and 32 oz. of tap water. The temperature of the bath is raised to 85° C. (185° F.). In addition to the 100 No. 316 stainless steel balls, 6 noncorrodible steel discs, smooth and free from rough edges, having a diameter of 30±2 mm, a thickness of 3±0.5 mm and a weight of 20±2 g are added to the test container. Finally, four 45 minute cycles are run rather than a single such cycle. It has been found that carrier supported ink-printed fabric labels treated according to the present invention which passed this test can withstand more than fifty commercial industrial launderings.

Plastic films, such as those made of polyethylene terephthalate, that have been printed using this method are resistant to abrasion and to attack by chemicals such as ferric chloride, acetone, methyl ethyl ketone, toluene, alcohols and halogenated hydrocarbons, making such films suitable for many industrial and electronics identification applications where chemical and abrasion resistance is required.

Figure 2:
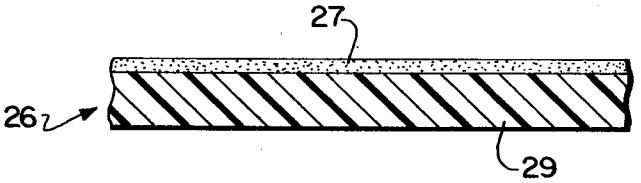
FIG. 2 is an enlarged elevational view of a carrier supported ink in accordance with the present invention.

The process of the present invention may be better understood by referring to FIG. 1 which is a plan view of an apparatus suitable for use in practicing the process. The apparatus comprises a hot stamping machine, referred to generally by the numeral 10, and a device for applying heat and pressure to the printed substrate to sublime the dye, referred to generally by the numeral 40. Any commercially available hot stamping machine which is capable of applying the required amounts of heat and pressure, such as the Models 155, 255, 355 and 455 fabric label printers from Markem Corporation, can be employed in the practice of the invention. Fabric or plastic film tape 12 to be printed on is fed into the hot stamping machine 10 from a roll 14 around an idler wheel 16 and a spring-loaded dancer arm 18, which controls the tension applied to the tape 12, and between heated platen 20 with printing matrices 22 and back-up pad 24. FIG. 2 is an enlarged elevational view of a carrier supported ink 26 suitable for use in the process of the invention. Carrier supported ink 26 comprises a layer 27 of an ink composition containing a sublimable dye coated on a carrier substrate 29. Referring to FIG. 1, carrier supported inks **26*a*, 26*b* and 26*c* are unwound from a roll 28 and fed into the hot stamping machine 10 so that the uncoated side faces the printing matrix 22 on the heated platen 20 and the ink coated side faces the surface of tape 12 to be printed. The opposite surface of the tape faces the back-up pad 24. The used carrier supported ink 26 is rewound on take-up roll 30. Tape 12 is then fed through seal registration adjustment 31, through main tape drive wheels 32, through heated sealing bars 34, through cut registration adjustment 36, and through cutter take-up drive wheels 38 located on device 40. Tape 12 pulled through drive wheels 38 is cut into labels by scissors cutter 42. The labels are advanced by transfer belt 44 driven in a counterclockwise direction and transfer belt 46 driven in a clockwise direction, when viewed from above. An inner belt 48 which can be made of metal, for example, is driven in a clockwise direction by heated drum 50 around idler wheels 52. An outer belt 54 made, for example, of fiberglass impregnated with Teflon, is driven in a counterclockwise direction around idler wheels 56 and adjacent to inner belt 48 in a clockwise direction around heated drum 50. Outer belt 54 is heated by belt heating shoe 58 which contacts the inner surface of the belt just prior to the initial point of contact of inner belt 48 and outer belt 54. Adjacent to the final point of contact between the inner and outer belts is a pair of label transfer rolls 60 which remove the labels from between the two belts and insert them into label stacker 62 where they are stacked by the reciprocating action of tamper 64**.

In operation, fabric or plastic film label tape 12 is pulled by means of main label drive wheels 32 thereby unwinding it from roll 14. The tension on the tape between the carrier supported inks **26*a*, 26*b* and 26*c* and the back-up pad 24 is maintained constant by means of dancer arm 18. The platen 20 and the printing matrix 22 having raised portions thereon, which correspond to the image to be printed onto the tape substrate, are first heated to a temperature in the range of about 52° C. (125° F.) to about 205° C. (401° F.). When the section of the tape to be printed is positioned adjacent to an unused portion of carrier supported ink 26*a* between heated printing matrix 22 and back-up pad 24, pressure is applied against either platen 20 or pad 24 to force the ink coated surface of carrier supported ink 26*a* against the surface of tape 12. A pressure in the range of about 100 psi to about 1000 psi is applied for a period of from about 0.1 second to about 1 second. It will be appreciated that as the temperature of the printing matrix is increased or as the pressure applied to the printing matrix or back-up pad is increased, the dwell time required to completely transfer the ink from the carrier to the surface of the substrate is decreased. Thus, the temperature of the printing matrix, the pressure and the dwell time must be adjusted until the ink coating is completely transferred to the surface of tape 12 in the image corresponding to the raised portions on the heated matrix 22. Used carrier supported ink 26*a* is then rewound on a take-up roll 30 and an unused portion of carrier supported ink 26*a* is then moved into position between tape 12 and printing matrix 22. If more than one color is to be printed on the tape, the tape is then pulled to a position adjacent to a second carrier supported ink 26*b* with a different color ink and a second heated printing matrix having a different image thereon, and then to a position adjacent to a third carrier supported ink 26*c*** with a further color ink and a third heated printing matrix.

After the tape has been printed with the ink containing the sublimable dye, it is pulled through seal registration adjustment 31 by main label drive wheels 32. If the tape being used to prepare the printed labels is made of a woven fabric, the cut edges of the tape will unravel and fray during use. If the fabric is made of a thermoplastic material, this problem can be alleviated by heat sealing the cut edges. In FIG. 1, a band of the fabric tape is fused between two portions of the tape which have been printed with the desired image by means of heated sealing bars 34. The distance that the tape travels can be adjusted by means of seal registration adjustment 31, which comprises an idler wheel on the end of an adjustable rotatable arm, so that the sealing bars contact the surfaces of the tape in the desired areas between the printed images on the tape. The tape 12 is then pulled through cut registration adjustment 36 by cutter take-up drive wheels 38. Cut registration adjustment 36 comprises an adjustable rotatable arm and idler wheel arrangement similar to that of seal registration adjustment 31. The distance the tape travels can again be adjusted by cut registration adjustment 36 so that scissors cutter 42 cuts the tape in the middle of each fused band made on the tape by the heated sealing bars 34. Upon being cut by cutter 42, the printed labels are fed into the nip where transfer belt 44 moving in a counterclockwise direction and transfer belt 46 moving in a clockwise direction initially come into contact. The printed labels are then conveyed between transfer belts 44 and 46 and fed into the nip where outer belt 54 moving in a counterclockwise direction and inner belt 48 moving in a clockwise direction initially come into contact. The printed labels are then heated as they are conveyed between outer belt 54 heated by shoe 58 and inner belt 48 heated by drum 50 around the circumference of drum 50 in a clockwise direction. The printed labels are heated to above the sublimation temperature of the dye contained in the ink composition for a period of time which is sufficient to permit all of the dye to sublime or vaporize from the ink and diffuse into the surface of the tape substrate. The printed labels are generally heated to a temperature in the range of about 140° C. (284° F.) to about 224° C. (435° F.) between the belts for a period of about 2 to about 10 seconds. As soon as the labels, which have by then been permanently marked by the dye, exit from the last point of contact of belts 48 and 54, they are transferred by rolls 60 to label stacker 62. As each permanently marked label is inserted into stacker 62 by rolls 60, it is pushed back into the stacker by tamper 64 to make room for the next label to be inserted. It will be appreciated that any source of energy which is sufficient to heat the printed substrate to cause the dye in the ink composition to sublime and diffuse into the surface of the substrate can be used in place of heating device 40 shown in FIG. 1.

Figure 3:
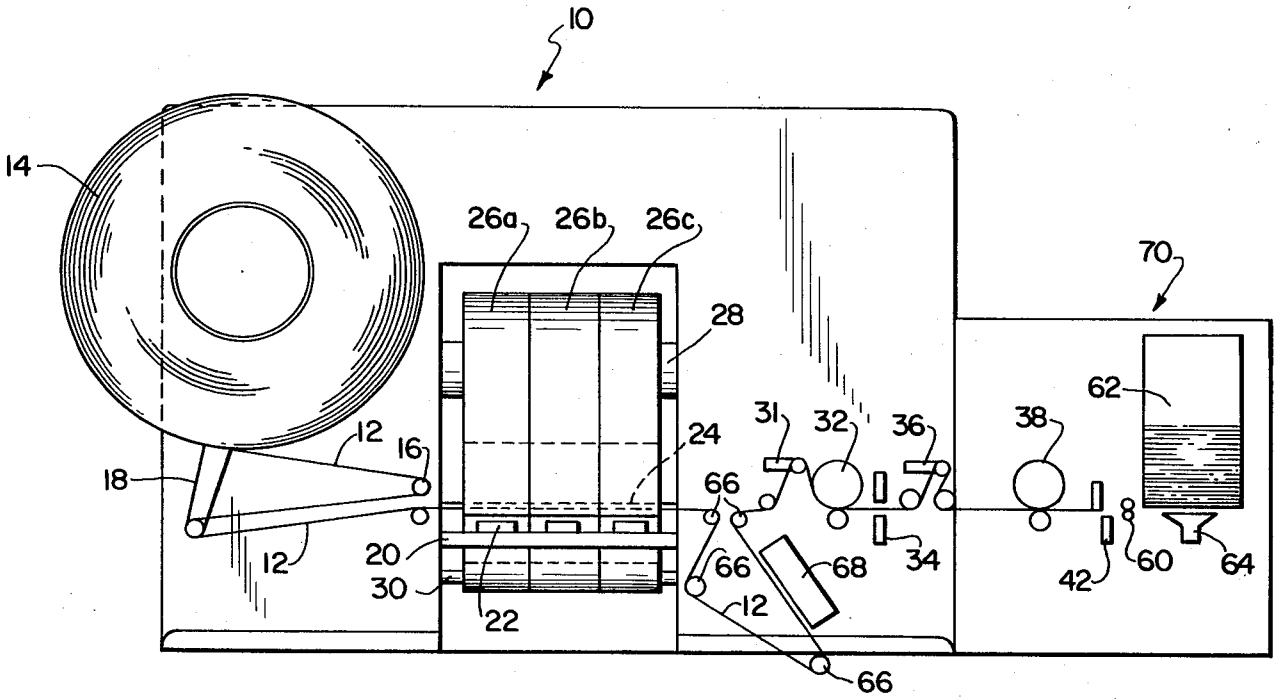
FIG. 3 is a plan view of a further apparatus suitable for use in practicing the process of the present invention.

A second apparatus suitable for use in practicing the process of the present invention is shown in FIG. 3, in which the same numerals refer to same parts shown in FIG. 1. The parts of machine 10 for hot stamping the tape 12 using the carrier supported ink 26 are the same as those shown in FIG. 1. Tape 12 is fed into the hot stamping machine 10 from roll 14 around idler wheel 16 and dancer arm 18 between heated platen 20 with printing matrices 22 and back-up pad 24. Then, tape 12 is fed around idler wheels 66 past the face of a gas discharge lamp 68, such as a xenon flash lamp, through seal registration adjustment 31, through main tape drive wheels 32, through heat sealing bars 34, and through cut registration adjustment 36. From that point, tape 12 is fed through cutter take-up drive wheels 38, cut into labels by scissors cutter 42, and advanced by label transfer rolls 60 into label stacker 62 with tamper 64, all located on attachment 70 extending from hot stamping machine 10. The operation of the apparatus shown in FIG. 3 is identical to that described above in connection with the apparatus shown in FIG. 1 through printing of the images on tape 12 using carrier supported inks **26*a*, 26*b* and 26*c*. After the tape has been printed, it is pulled around idler wheels 66 so that is passes in front of a gas discharge lamp 68, such as a xenon flash lamp, with the printed images on the tape facing the lamp. As each printed image passes the front of the lamp 68, the lamp is energized and the flash heats the sublimable dye in the ink above its sublimation temperature causing the dye to sublime and then diffuse into the tape 12. A xenon flash lamp discharging at an energy density of 2.3 joules/cm$^2$ for a period of 0.25 second has been found to be suitable. After the tape has been exposed to the flash lamp and permanently dyed, it is pulled through seal registration adjustment 31 by main drive wheels 32. If the tape 12 is made of fabric that will fray or unravel when cut, then a band of the tape is fused between two printed portions by means of heated sealing bars 34. The tape 12 is then pulled through cut registration adjustment 36 by cutter take-up drive wheels 38, and then cut into labels by scissors cutter 42 in the middle of each fused band. Upon being cut, the printed labels are then transferred by rolls 60 to label stacker 62 where they are pushed back into a stack by tamper 64**.

A more complete appreciation of the invention will be realized by reference to the following specific examples which relate to specific ink compositions and carrier supported inks and to methods for preparing such compositions and carrier supported inks and for using such carrier supported inks to permanently print specific substrate materials. The following examples are not intended to limit the invention disclosed herein except to the extent that limitations are specifically stated or to the extent that limitations appear in the appended claims.

EXAMPLE 1

Into a mixing vessel was added 20 grams of an acrylic terpolymer emulsion (UCAR 503, 58%, TS, Union Carbide) and 50 grams of water. The mixture was then placed in an air-driven propeller-type mixer until the ingredients are thoroughly mixed. After the pH of the mixture was adjusted to 8.0–9.0, 50 grams of a carnauba wax and polymer dispersion containing 29% carnauba wax and 5% acrylic polymer (Jonwax 22, S. C. Johnson) and 40 grams of an aqueous dispersion of a black sublimable dye (Foron Black SK paste, 50% TS, Sandoz) were added to the mixture and mixing was continued until all of the ingredients were thoroughly mixed. After mixing, the ink composition was filtered through a filter bag and then the pH, viscosity, surface tension and solids content were checked and adjusted where appropriate.

The ink composition was then coated onto a 1.5 mil treated high density polyethylene film (Philjo #685, Phillips Joanna) by means of a coater. The ink was pumped into a supply pan located beneath the film where it was picked up by an inking roll and applied to the underside of the film in a heavy coat at a rate of 20 ft./min. Excess ink was then metered off of the film by means of a #20 Meyer bar to the appropriate thickness. The coated carrier film was then passed through a hot air tunnel at 176° F. and dried. The dried ink coating comprised about 41 percent by weight of the sublimable dye, about 29 percent by weight of resin components, and about 30 percent by weight of wax. The dried coated carrier was then rewound onto a large roll, and after inspection for faults, rewound into smaller rolls and cut into narrow widths suitable for use in the hot stamping equipment.

A narrow web of the carrier supported ink which was prepared when fed into a Markem Model 355 fabric label printer. The printing matrix of the printer was heated to 200° F. A polyester fabric label tape (Markem #570) was then printed with the carrier supported ink using normal pressure about 150–200 psi and a dwell time of 1/300 sec. 90–100 percent of the ink coating transferred to the surface of the fabric tape to produce a good print.

The printed fabric label was then heated by a source of hot pressurized air discharging from a nozzle at a temperature of about 650° F. while the label tape as moving at a rate of 20 ft./min. to sublime the dye in the printed image into the surface of the fabric. The finished label was then washed using the modification of AATCC test method 61–1980, test No. IVA, described above, which closely simulates the effects of harsh industrial launderings. The washed label exhibited good washfastness.

EXAMPLE 2

A carrier supported ink was prepared using the ink composition and procedure set forth in Example 1 above. The carrier film was coated at the rate of 15 ft./min. An image was printed onto a fused slit polyester (#600, Royal Ribbon Co.) fabric label tape and a woven edge polyester fabric label tape (Markem #570) using the carrier supported ink which was prepared with a Markem Model 355 fabric label printer. The printing matrix of the printer was heated to 360° F. The printed Markem #570 label was then heated in a hot air at 625° F., 30 psi, 18 ft./min. speed to sublime the dye from the ink into the fabric. The printed #600 label was likewise heated at 625° F., 30 psi, 20 ft./min. speed. Both finished labels were then washed using the modified AATCC wash test described above. The washed labels both exhibited good washfastness.

EXAMPLE 3

Using an ultrasonic mixer, 1 part by weight of a yellow sublimable dye (SE-SCW Foron Yellow, Sandoz) was first dispersed in 1 part by weight of water. Into an air-driven propeller-type mixer was added 20 grams of an acrylic terpolymer emulsion (UCAR 503) and 50 grams of water, which were then thoroughly mixed. The pH was then adjusted to 8.9 followed by addition of 50 grams of a carnauba wax and polymer dispersion (Jonwax 22) and 40 grams of the yellow dye dispersion previously prepared. The ink composition was then coated onto a high density polyethylene carrier film (Philjo #606, Phillips Joanna) using the procedure set forth in Example 1 above at a rate of 10 ft./min. Excess ink was metered off the untreated polyethylene film with a #10 Meyer bar. The excess ink on a first treated polyethylene film was metered off with a #10 Meyer bar and that on a second treated polyethylene film was metered off with a #14 Meyer bar. All of the coated films were then dried in a hot air tunnel at 160° F. The dried ink composition or the carrier comprised about 41 percent by weight of the sublimable dye, 29 percent by weight of the resin components, and 30 percent by weight of the wax.

The three resulting carrier supported inks were then used in a Markem Model 355 fabric label printer with the printing matrix at a temperature of about 250° F. to print onto a polyester fabric label tape (Markem #570). The printed labels were then heated as in Example 1 above to sublime the dye from the ink into the fabric. The prints made with the carrier supported ink prepared using the untreated polyethylene film were considered good, and when washed using the modified AATCC wash test described above, exhibited good washfastness. The prints made with the carrier supported inks prepared using the treated polyethylene film were poor, and therefore, were not tested for washfastness. The ink composition did not release well from the polyethylene film treated with corona discharge which caused the ink to adhere too tenaciously.

EXAMPLE 4

Using the procedure of Example 3 above, 42.7 parts by weight of a blue sublimable dye (Foron 5-BGL Blue, Sandoz) was dispersed in 57.3 parts by weight of water with an ultrasonic mixer. Into the mixer was added 40 grams of an acrylic terpolymer emulsion (UCAR 503) and 100 grams of water, which were then thoroughly mixed. After adjusting the pH of the mixture to 8–9, 100 grams of a carnauba wax and polymer dispersion (Jonwax 22), 80 grams of the blue sublimable dye dispersion, and 5 drops of an antifoaming agent (Orco Antifoam NS-FP) were added and then thoroughly mixed with the other ingredients. The resulting ink composition was then coated onto a 1.5 mil untreated high density polyethylene film (Philjo #606), a 1.5 mil treated high density polyethylene film (Philjo #606), a 0.5 mil treated polyethylene terephthalate film (Hostaphan 2000, American Hoechst), and a 1.0 mil treated polypropylene film (B502, Hercules) using the procedure of Example 1 above. The coatings were metered off of the carrier films using a #10 Meyer bar. The dried ink compositions comprised about 37.5 percent by weight of sublimable dye, about 30.5 percent by weight of resin components, and about 32 percent by weight of wax. Each of the carrier supported inks so prepared were then used in a Markem Model 355 fabric label printer to print onto a polyester fabric label tape (Markem #570). The ink composition released well only from the untreated polyethylene carrier because the surfaces of all of the other carrier films had been corona discharge treated causing the ink to adhere too tenaciously.

EXAMPLE 5

Using the procedure of Example 3 above, 500 grams of a yellow sublimable dye (Flavine Yellow S-8GF, Sandoz) was first dispersed in 500 grams of water using an ultrasonic mixer for 4 minutes, reaching a temperature of 120° F. Then, 40 grams of an acrylic terpolymer emulsion (UCAR 503) was thoroughly mixed in 100 grams of water using an air-driven propeller-type mixer. After adjusting the pH to 8–9, 100 grams of a carnauba wax and polymer dispersion (Jonwax 22) and 80 grams of the yellow sublimable dye dispersion previously prepared were added to the mixture and thoroughly mixed with the other ingredients. The resulting ink composition was then coated onto a 1.25 mil untreated polyethylene film (Philjo #606) at a rate of 10 ft./min. The excess ink was metered off with a #8 Meyer bar. The coated film was then dried in a hot air tunnel at 100° F. The dried ink composition comprised about 41 percent by weight of sublimable dye, about 29 percent by weight of resin components, and about 30 percent by weight of wax. When the carrier supported ink was used in a Markem Model 355 fabric label printer, it exhibited good release of the ink coating to the fabric substrate.

EXAMPLE 6

Following the procedure of Example 5 above, 500 grams of an orange sublimable dye (Foron Orange S-GF, Sandoz) was first dispersed in 500 grams of water in an ultrasonic mixer for 2 minutes, reaching a temperature of 100° F. Then, an ink composition as prepared using the formula of Example 5, replacing the dispersion of yellow dye with the same amount of orange sublimable dye dispersion which was prepared, which was then coated on the untreated polyethylene carrier film (Philjo #606) using the procedure of Example 5. The resulting carrier supported ink was found to exhibit good release of the ink coating from the carrier onto the fabric substrate and good color when used in a Markem Model 355 fabric label printer. Printed fabric labels were then heated to cause the dye in the ink to sublime into the fabric as described in Example 1. The finished labels were then washed using the modified AATCC wash test described above and were found to exhibit good washfastness. After aging, the ink coating on the carrier had lost more water and solvent to the atmosphere so that the coating easily fell off the carrier when flexed. The adhesion to the carrier can be improved by increasing the ratio of resin to sublimable dye in the ink composition.

EXAMPLE 7

An ink composition was prepared using the procedure of Example 6 above. Into an air-driven propeller-type mixer were added 40 grams of an acrylic terpolymer emulsion (UCAR 503, 58.5% TS, Union Carbide) and 100 grams of water and then thoroughly mixed. After adjusting the pH of the mixture to 8–9, 100 grams of a carnauba wax and polymer dispersion (Jonwax 22) and 60 grams of the aqueous dispersion of orange sublimable dye prepared in Example 6 were added and thoroughly mixed with the other ingredients. The ink composition as then coated onto an untreated polyethylene carrier film and the excess was metered off using a #8 Meyer bar. The dried ink composition comprised about 34 percent by weight of sublimable dye, about 33 percent by weight of resin components, and about 33 percent by weight of wax. The dried coating was observed to be too streaky. The same carrier film was then coated with the same ink composition using a #10 Meyer bar to apply a thicker coating. A polyester fabric label tape (Markem #570) was printed with the resulting carrier supported ink in a Markem Model 355 fabric label printer, and then heated to cause the dye in the ink to sublime into the fabric as described in Example 1. The finished labels were then subjected to a wet crocking test (AATCC Test Method 8-1981). Since there was too much sublimable dye in the ink printed on the surface of the fabric, it did not all sublime into the fabric and therefore, was partially removed during the crock test. The solids content of the ink composition was then reduced 20 percent by adding more water so that the ink coating would contain less sublimable dye. The carrier film was then coated with the diluted ink composition and the excess was metered off with a #10 Meyer bar. A good coating was produced on the carrier. Finished fabric labels which had been printed with the new carrier supported ink and heated as above were found to exhibit good wet crocking properties.

EXAMPLE 8

Using the procedure of Example 1, 20 grams of an acrylic terpolymer emulsion (UCAR 503) and 50 grams of water were added to an air-driven propeller-type mixer and thoroughly mixed. Following adjustment of the pH to 8.0–9.0, 50 grams of a carnauba wax and polymer dispersion (Jonwax 22) and 30 grams of an aqueous dispersion of a black sublimable dye (Foron Black SK paste) were added and thoroughly mixed with the other ingredients for 15 minutes. The resulting ink composition was then coated onto a 1.25 mil untreated polyethylene carrier film (Philjo #606) and at a rate of 10 ft./min. The excess ink was metered off with a #10 Meyer bar. The coated film was then dried in a hot air tunnel at 120° F. The dried ink composition comprised about 34 percent by weight of sublimable dye, about 33 percent by weight of resin components, and about 33 percent by weight of wax. The coating on the carrier exhibited good color, but had lines in it, and therefore, was considered poor. The carrier was then coated and the excess removed with a #12 Meyer bar. The resulting coating, however, was then too dense, so 120 grams of the ink composition prepared above was diluted with 20 grams of water. The carrier was coated with the diluted ink composition and the excess was removed with a #12 Meyer bar. Dilution with water resulted in a lower solids deposition on the carrier which produced prints that would not crock when subjected to the wet crocking test described above.

EXAMPLE 9

Using the procedure of Example 1 above, an ink composition was prepared by thoroughly mixing 40 grams of an acrylic terpolymer emulsion (UCAR 503) and 140 grams of water, 100 grams of a carnauba wax and polymer dispersion (Jonwax 22), and 100 grams of an aqueous dispersion of a black sublimable dye (Foron Black SK). The resulting ink composition was then coated onto a 0.5 mil polyethylene terephthalate film (DuPont) and a 1.25 mil untreated polyethylene film (Philjo #606) at a rate of 10 ft./min. The excess ink was metered off both coated films with a #12 Meyer bar. The coated films were then dried in a hot air tunnel at 120° F. The dried ink composition comprised about 46.5 percent by weight of sublimable dye, about 26.5 percent by weight of resin components, and about 27 percent by weight of wax. A polyester fabric label tape (Markem #570) was then printed and heated as above with both carrier supported inks. Good prints were obtained using both carrier supported inks.

EXAMPLE 10

Using the procedure of Example 1 above, 80 grams of an acrylic terpolymer emulsion (UCAR 503) was thoroughly mixed with 200 grams of water in a high speed disperser. The pH was then adjusted to 9.2. Then, 200 grams of a carnauba wax and polymer dispersion (Jonwax 22) and 120 grams of a dispersion of 1 part by weight of a yellow sublimable dye (Amacron Yellow GSE, American Color & Chemicals) in 1 part by weight of water were added and thoroughly mixed with the other ingredients. The resulting ink composition was then coated onto a 1.25 mil medium treated polyethylene carrier film (Philjo #606) at a rate of 10 ft./min. The excess ink was metered off with a #8 Meyer bar and the coated film was dried in a hot air oven at 120° F. The dried ink composition comprised about 34 percent by weight of sublimable dye, about 33 percent by weight of resin components, and about 33 percent by weight of wax. The ink coating on the carrier exhibited some flaking, but produced a good print when used in a Markem Model 355 fabric label printer to print polyester fabric label tape (Markem #570). The printed labels were heated to cause the dye in the ink to sublime into the fabric as described in Example 1 above and then washed using the modification of the AATCC wash test described above. The labels were found to exhibit good washfastness.

EXAMPLES 11–12

Using the procedure of Example 3 above, two different yellow sublimable dye dispersions were prepared by mixing 1 part by weight of each of Foron Yellow S-4GL (Sandoz) and Foron Yellow E-3GFL (Sandoz) in 1 part by weight of water using an ultrasonic mixer until the dispersion temperature reached 120° F. Each of two ink compositions was then prepared by thoroughly mixing 40 grams of an acrylic terpolymer emulsion (UCAR 503) and 100 grams of water in the mixer. After the pH was adjusted to 8.0–9.0 in each mixture, 100 grams of a carnauba wax and polymer dispersion (Jonwax 22) and 60 grams of one of the previously prepared yellow dye dispersions were added to each of the mixtures and then thoroughly mixed with the other ingredients. Each ink composition was then coated onto a carrier film. The dried ink compositions comprised about 34 percent by weight of sublimable dye, about 33 percent by weight of resin components, and about 33 percent by weight of wax. A polyester fabric label tape (Markem #570) was then printed with each of the carrier supported inks prepared. All of the printed images exhibited good color.

EXAMPLE 13

An ink composition containing a dye with a lower sublimation temperature than those previously employed was prepared using the procedure of Example 1 above. To an air-driven propeller-type mixer were added 40 grams of an acrylic terpolymer emulsion (UCAR 503) and 100 grams of water which were then thoroughly mixed. After adjusting the pH to 8.0–9.0, 100 grams of a carnauba wax and polymer dispersion (Jonwax 22) and 60 grams of a low energy black sublimable dye (Foron Black E-DP, 50% TS, Sandoz) were added to the mixture and then thoroughly mixed with the other ingredients. The resulting ink composition was then coated onto a 1.25 mil polyethylene film (Philjo #606). The dried ink composition comprised about 34 percent by weight of the sublimable dye, about 33 percent by weight of the resin components, and about 33 percent by weight of the wax. The carrier supported ink was then used in a Markem Model 355 fabric label printer to print on a polyester fabric label tape (Markem #570). The printed labels were then heated causing the dye in the ink to sublime into the fabric and then partially resublime. The finished labels were washed using the modified AATCC wash test described above. The labels did not exhibit washfastness. Instead, 80% of the dye was removed from the fabric due to resublimation of the dye subjected to the extended period of heating during the washing test.

EXAMPLE 14

A carrier supported ink containing a blue sublimable dye was prepared using the procedure of Example 1 above. Into a high speed disperser were added 40 grams of an acrylic terpolymer emulsion (UCAR 503) and 100 grams of water, which were then thoroughly mixed. The pH was adjusted to 8.0–9.0 and then 100 grams of a carnauba wax and polymer dispersion (Jonwax 22) and 60 grams of an aqueous dispersion of a blue sublimable dye (Foron Blue S-BGL, Sandoz) were added to the mixture and thoroughly mixed with the other ingredients. The resulting ink composition was then coated onto a 1.25 mil polyethylene film (Philjo #606). The dried ink composition comprised about 34 percent by weight of sublimable dye, about 33 percent by weight of resin components, and about 33 percent by weight of wax A polyester fabric label tape (Markem #570) was then printed using the carrier supported ink prepared in a Markem Model 355 fabric label printer. The printed images exhibited good color. The printed labels were then heated as described in Example 1 to cause the dye in the ink to sublime into the fabric. The finished labels were then washed using the modified AATCC wash test described above. The labels exhibited good washfastness.

EXAMPLE 15

A carrier supported ink containing a turquoise sublimable dye was prepared using the procedure of Example 1 above. The ink composition was prepared by thoroughly mixing 40 grams of an acrylic terpolymer emulsion (UCAR 503) and 100 grams of water in a high speed disperser, adjusting the pH to 8.0–9.0, adding 100 grams of a carnauba wax and polymer dispersion (Jonwax 22), 60 grams of an aqueous dispersion of a turquoise sublimable dye (Foron Turquoise S-GBL, Sandoz) and 80 grams of water to the mixture, and then thoroughly mixing all of the ingredients. The ink composition was then coated onto a 1.25 mil polyethylene film (Philjo #606). The dried ink composition comprised about 34 percent by weight of sublimable dye, about 33 percent by weight of resin components, and about 33 percent by weight of wax. The carrier supported ink which was prepared was found to produce good color prints on a polyester fabric label tape (Markem #570) using a Markem Model 355 fabric label printer. After being heated to cause the dye to sublime into the fabric as described in Example 1, the labels were washed using the modified AATCC wash test described above and were found to exhibit good washfastness.

EXAMPLE 16

Using the procedure of Example 1 above, 25 grams of a carnauba wax and polymer dispersion (Jonwax 22), 15 grams of an aqueous dispersion of a black sublimable dye (Foron Black SK), and 60 grams of water were thoroughly mixed using an air-driven propeller-type mixer. The resulting ink composition was coated onto A 1.25 mil polyethylene film (Philjo #606). The dried ink composition comprised about 47 percent by weight of sublimable dye, about 8 percent by weight of resin, and about 45 percent by weight of wax. The carrier supported ink which was prepared was found to produce good color prints on a polyester fabric label tape (Markem #570) using a Markem Model 355 fabric label printer. The printed labels were heated to cause the dye to sublime into the fabric and then washed using the modified AATCC wash test described above. The washed labels exhibited good washfastness.

EXAMPLE 17

Using the procedure of Example 1 above, 15 grams of an aqueous dispersion of a black sublimable dye (Foron Black SK), 10 grams of an acrylic terpolymer emulsion (UCAR 503), and 75 grams of water were thoroughly mixed with an air-driven propeller-type mixer. The resulting ink composition was then coated onto a 1.25 mil polyethylene film (Philjo #606). The dried ink composition comprised 56 percent by weight of sublimable dye and 44 percent by weight of resin. The carrier supported ink was used in a Markem Model 355 fabric label printer to print images on a polyester fabric label tape (Markem #570). The ink coating was found to poorly release from the carrier, tearing out pieces of the coating rather than sharply defined images corresponding to the raised portions in the heated printing matrix.

EXAMPLE 18

Using the procedure of Example 1 above, 15 grams of an aqueous dispersion of a black sublimable dye (Foron Black SK) was thoroughly mixed with 85 grams of water. The resulting ink composition was then coated onto a 1.25 mil lightly treated polyethylene film (Philjo #606). The ink poorly coated the carrier film. The dried ink composition contained 100 percent sublimable dye. The carrier supported ink was used to print polyester fabric labels (Markem #570) with a Markem Model 355 fabric label printer. The printed images produced were very poor.

EXAMPLE 19

Using the procedure of Example 1 above, 140 grams of an aqueous dispersion of a black sublimable dye (Foron Black SK), 30 grams of a carnauba wax and polymer dispersion (Jonwax 22) and 100 grams of water were thoroughly mixed. The resulting ink was then coated onto lightly treated polyethylene (Philjo #606) at a rate of 100 ft./min. Excess ink was metered off with a #10 Meyer bar. The coated film was dried in a hot air oven at 140° F. The dried ink composition comprised about 87 percent by weight of sublimable dye, about 2 percent by weight of resin, and about 11 percent by weight of wax. The carrier supported ink was used to print a polyester fabric label tape (Markem #570) with a Markem Model 355 fabric label printer. The printed images were gray in color indicating less than 100 percent transfer. The printed labels were then heated to sublime the dye into the fabric and washed using the modified AATCC wash test described above. The washed labels exhibited good washfastness. More wax should be added to the ink composition in order to obtain good dense black print and total transfer.

EXAMPLE 20

Using the procedure of Example 1 above, an ink composition was prepared by thoroughly mixing an aqueous dispersion of a black sublimable dye (Foron Black SK) and an acrylic terplymer emulsion (UCAR 503). The resulting ink was coated on a treated polyethylene film (Philjo #606). Excess ink was removed using #8 and #10 Meyer bars The dried ink composition comprised 15 percent by weight of sublimable dye and 85 percent by weight of resin. The carrier supported ink was employed in a Markem Model 355 fabric label printer using a printing matrix heated up to 250° F. to print on a polyester fabric label tape (Markem #570). All of the prints produced were sticky and blotchy.

EXAMPLE 21

Using the procedure of Example 1 above, 42.5 grams of a carnauba wax and polymer dispersion (Jonwax 22), 42.5 grams of an acrylic terpolymer emulsion (UCAR 503), and 1.5 grams of an aqueous dispersion of a black sublimable dye (Foron black SK) were thoroughly mixed. The resulting ink composition was then coated onto a 1.25 mil polyethylene film (Philjo #606). The excess ink was metered off with a #16 Meyer bar. The dried ink composition comprised about 2 percent by weight of sublimable dye, about 67 percent by weight of resin components, and about 31 percent by weight of wax. The carrier supported ink was employed in a Markem Model 355 fabric label printer in which the printing matrix was heated to 240° F. to print on a polyester fabric label tape (Markem #570). Although gray in color, the prints were considered good. The printed labels were then heated to sublime the dye into the fabric and washed using the modified AATCC wash test described above. The washed labels exhibited good washfastness.

EXAMPLE 22

Using the procedure of Example 1 above, 57 grams of a carnauba wax and polymer dispersion (Jonwax 22), 40 grams of an acrylic terpolymer emulsion (UCAR 503), and 3 grams of an aqueous dispersion of a black sublimable dye (Foron Black SK) were thoroughly mixed. The resulting ink composition was then coated onto a 1.25 mil polyethylene film (Philjo #606). Excess ink was metered off with a #10 Meyer bar. The dried ink composition comprised about 3.5 percent by weight of sublimable dye, about 59 percent by weight of resin components, and about 37.5 percent by weight of wax. Using a Markem Model 355 fabric label printer, the carrier supported ink produced good gray prints on a polyester fabric label tape (Markem #570). After the printed labels were heated to cause the dye to sublime into the fabric, the finished labels were washed using the modified AATCC wash test described above. The washed labels exhibited good washfastness.

EXAMPLE 23

Using the procedure of Example 1 above, an ink composition was prepared by thoroughly mixing 53.2 grams of a carnauba wax and polymer dispersion (Jonwax 22), 37.4 grams of an acrylic terpolymer emulsion (UCAR 503), and 9.3 grams of an aqueous dispersion of a black sublimable dye (Foron Black SK). A 1.25 mil polyethylene film (Philjo #606) was then coated with the resulting ink composition. The dried ink composition comprised about 10 percent by weight of sublimable dye, about 55 percent by weight of resin components, and about 35 percent by weight of wax. The carrier supported ink was employed in a Markem Model 355 fabric label printer to print onto a polyester fabric label tape (Markem #570). The prints were grayish in color. The printed fabric labels were heated to sublime the dye into the fabric and then washed using the modified AATCC wash test described above. The washed labels exhibited good washfastness.

EXAMPLE 24

Using the procedure of Example 1 above, 22 grams of a carnauba wax and polymer dispersion (Jonwax 22), 9 grams of an acrylic terpolymer emulsion (UCAR 503), 13.5 grams of an aqueous dispersion of a black sublimable dye (Amacron Black, American Color & Chemicals), and 55.5 grams of water were thoroughly mixed to prepare an ink composition which was then coated onto a 1.25 high density polyethylene film (Philjo #606). Excess ink was metered off of coated films using #10, #12, #14 and #16 Meyer bars. The coated films were then dried in a hot air tunnel. The dried ink composition comprised about 35 percent by weight of sublimable dye, about 32 percent by weight of resin components, and about 33 percent by weight of wax. Carrier supported inks prepared using the #10 and #12 Meyer bars did not produce good prints. Those prepared using the #14 and #16 Meyer bars did not dry well even when the tunnel temperature was raised to 250° F.

EXAMPLE 25

Using the procedure of Example 1 above, an ink composition was prepared by thoroughly mixing 42.5 grams of a carnauba wax and polymer emulsion (Jonwax 22), 42.5 grams of an acrylic terpolymer emulsion (UCAR 503), and 15 grams of an aqueous dispersion of a black sublimable dye (Foron Black SK). The ink composition was then coated onto a 1.25 mil high density polyethylene film (Philjo #606). The dried ink composition comprised about 16 percent by weight of sublimable dye, about 58 percent by weight of resin components, and about 26 percent by weight of wax. The carrier supported ink was then used in a Markem Model 355 fabric label printer to print images on a polyester fabric label tape (Markem #570). Good prints were produced.

EXAMPLE 26

Using the procedure of Example 1 above, an ink composition was prepared by thoroughly mixing 22 grams of a carnauba wax and polymer dispersion (Jonwax 22), 9 grams of an acrylic terpolymer emulsion (UCAR 503), 73 grams of an aqueous dispersion of a black sublimable dye (Foron Black SK), and 40 grams of water. The resulting ink composition was then coated onto a 1.25 high density polyethylene film (Philjo #606). The dried ink composition comprised about 74 percent by weight of sublimable dye, about 13 percent by weight of resin components, and about 13 percent by weight of wax. Using a Markem Model 355 fabric label printer, a polyester fabric label tape (Markem #570) was printed with the carrier supported ink prepared. Good prints were produced.

EXAMPLE 27

Using the procedure of Example 1 above, an ink composition was prepared by thoroughly mixing 22 grams of a carnauba wax and polymer dispersion (Jonwax 22), 9 grams of an acrylic terpolymer emulsion (UCAR 503), 219.6 grams of an aqueous dispersion of a black sublimable dye (Foron Black SK), and 50 grams of water. The resulting ink was then coated onto a 1.25 mil high density polyethylene film (Philjo #606). The dried ink composition comprised about 90 percent by weight of sublimable dye, about 5 percent by weight of resin components, and about 5 percent by weight of wax. A polyester fabric label tape (Markem #570) was then printed with the carrier supported ink using a Markem Model 355 fabric label printer. The prints produced on the fabric were poor due to the small amount of wax present in the ink relative to the large amount of sublimable dye.

EXAMPLE 28

An ink composition was prepared, using the procedure of Example 1 above, by thoroughly mixing 7.5 grams of a polyethylene was (Lanco Wax PP-1362-0, Capricorn Chemicals Corp.), 9 grams of an acrylic terpolymer emulsion (UCAR 503) and 13.5 grams of an aqueous dispersion of a black sublimable dye (Foron Black SK). A good dispersion was produced. The resulting ink composition was then coated onto a 1.25 mil high density polyethylene film (Philjo #606). The dried ink composition comprised about 35 percent by weight of sublimable dye, about 27 percent by weight of resin components, and about 38 percent by weight of wax. The carrier supported ink was then used in a Markem Model 355 fabric label printer to print images on a polyester fabric label tape (Markem #570). The prints produced were good. The printed fabric labels were heated to sublime the dye into the fabric and then washed using the modified AATCC was test described above. The washed labels exhibited good washfastness.

EXAMPLE 29

Using the procedure of Example 28 above, an ink composition was prepared in which the formula used was the same except for the use of 31.25 grams of a polyethylene wax dispersion (Waxplate 139, 24% TS, S. C. Johnson) to supply the wax component. The dried ink composition on the 1.25 mil high density polyethylene film (Philjo #606) comprised about 35 percent by weight of sublimable dye, about 27 percent by weight of resin components, and about 38 percent by weight of wax. The carrier supported ink produced good prints on a polyester fabric label tape (Markem #570) using a Markem Model 355 fabric label printer. The printed fabric labels were heated to sublime the dye into the fabric and then washed as above. The washed labels exhibited good washfastness.

EXAMPLE 30

Using the procedure of Example 28 above, an ink composition was prepared having the same formula except for the use of 7.5 grams of powdered carnauba wax #80 as the wax component. The dispersion of carnauba was poor. The dried ink composition on the 1.25 mil high density polyethylene film (Philjo #606) comprised about 35 percent by weight of sublimable dye, about 27 percent by weight of resin components, and about 38 percent by weight of wax. Using a Markem Model 355 fabric label printer with the carrier supported ink prepared above produced good prints on a polyester fabric label tape (Markem #570). The printed fabric labels were heated to sublime the dye into the field and then washed as above. The washed labels exhibited good washfastness.

EXAMPLES 31–35

A series of ink compositions containing sublimable dyes of different colors were prepared for use in the preparation of carrier supported inks according to the present invention. The ink compositions were prepared by thoroughly mixing 100 grams of water, 40 grams of an acrylic terpolymer emulsion (UCAR 503), 100 grams of a carnauba wax and polymer dispersion (Jonwax 22), and about 80 grams of an aqueous dispersion (50% TS) of one of five different colored sublimable dyes, Foron Brown S-3R, Foron Scarlet S-BWFl, Foron Rubine RD-2BLA, Foron Blue RD-GLA or Foron Yellow Brown S-2RFL, all from Sandoz Colors & Chemicals. All of the five ink compositions were then coated on 1.25 mil high density polyethylene films (Philjo #606). The dried ink compositions comprised about 41 percent by weight of the sublimable dye, about 29 percent by weight of the resin components, and about 30 percent by weight of the wax. When used in a Markem Model 355 fabric label printer, each of the carrier supported inks were found to produce good prints on a polyester fabric label tape (Markem #570). The printed fabric labels were heated to sublime the dye into the fabric and then washed as above. The washed labels exhibited good washfastness.

EXAMPLE 36

Using the procedure of Examples 31–35 above, a different colored ink composition was prepared by thoroughly mixing the same amounts of water, terpolymer emulsion, and wax dispersion with 68.5 grams of an aqueous dispersion (50% TS) of Foron Yellow RD-4GSL (Sandoz). The resulting ink composition was then coated on a 1.25 mil high density polyethylene film (Philjo #606). The dried ink composition comprised about 37.5 percent by weight of sublimable dye, about 30.5 percent by weight of resin components, and about 32 percent by weight of wax. The carrier supported ink produced good prints on a polyester fabric label tape (Markem #570) using a Markem Model 355 fabric label printer. The printed fabric labels were heated to sublime the dye into the fabric and then washed as above. The washed labels exhibited good washfastness.

EXAMPLE 37

A series of carrier supported inks were prepared to ascertain the suitability of the standard sublimation transfer paper and ink for use in the practice of the present invention.

The ink composition prepared in Example 8 above was coated onto a sheet of standard transfer paper (American Hoechst) and onto a sheet of untreated high density polyethylene film (Philjo #606) suitable for use as a carrier in the present carrier supported inks. A standard transfer printing ink (American Hoechst) was also coated onto a sheet of the same untreated high density polyethylene. In all cases, the excess ink was metered off of the carriers with a #8 Meyer bar.

A polyester fabric label tape (Markem #570) was then printed using the three carrier supported inks in a Markem Model 455 fabric label printer at standard printing matrix temperature of 124° C. (255° F.) and pressure of 150–200 psi, a cycle time of 0.4 second and a dwell time of 0.113 second. The ink composition from Example 8 which was coated on the standard transfer paper would not print on the fabric label tape. Likewise, the standard transfer printing ink coated on the polyethylene carrier would not print on the fabric. By contrast, 100 percent of the ink composition from Example 8 on the polyethylene carrier transferred to the fabric surface.

EXAMPLE 38

A series of prints were on several polyethylene terephthalate film substrates using a carrier supported ink prepared as described in Example 8 above in a Markem Model 455 fabric label printer with a printing matrix temperature of 120° C. (248° F.), a cycle time of 150 prints per minute, a dwell time of 0.113 second, and a pressure of 150–200 psi. The polyethylene terephthalate films employed as substrates were Melinex polyester film (ICI), Mylar polyester film with adhesive backing (DuPont), and aluminized Mylar polyester film with adhesive backing (DuPont). The printed substrates were then heated using a heated drum such as that shown in FIG. 1 to sublime the dye into the substrate. The drum and belts were heated to a temperature of 425° F. The belts were rotated around the drum at 20 RPM resulting in a dwell time of about 2.5 seconds.

The printed substrates were then immersed for 15 minutes in each of the following solvents: ethyl alcohol, acetone followed by toluene, ethyl acetate, Freon TF, and 5% aqueous ferric chloride solution. Following immersion in each solvent, the prints were rubbed vigorously with a cloth soaked in the solvent of the test. Virgin prints were subjected to vigorous abrasion by rubbing them 40 times with a typing eraser (Eberhard Faber #310 Union). There was no degradation of any of the prints tested.

EXAMPLE 39

An ink composition was prepared using a solvent soluble sublimable dye. Using an air driven propeller-type mixer, 10 grams of a yellow (C.I. #SOY 30) sublimable dye (Nitrofast Yellow B, Sandoz) where thoroughly mixed with 20 grams of water. This mixture was then added to a mixer containing 50 grams of water and 20 grams of an acrylic terpolymer emulsion (UCAR 503) and then thoroughly mixed. After adjusting the pH to 8.5–9.5, 50 grams of a carnauba wax and polymer dispersion (Jonwax 22) were added and mixed. The ink composition was then coated onto a 1.2 mil untreated polyethylene carrier film (Philjo #685). Excess ink was metered off with a #10 Meyer bar. The dried ink composition comprised about 26 percent by weight of sublimable dye, about 36.5 percent by weight of resin components, and about 37.5 percent by weight of wax. The carrier supported ink was then used in a Markem Model 355 fabric label printer to print on a polyester fabric label tape (Markem #570). The printed labels were then heated to sublime the dye into the fabric using a commercial heat seal unit (Pace Setter 500, Speedy Die, Inc.) with the top platen at 400° F. and the bottom platen at 375+ F. for a period of 1.0 to 2.5 seconds. Some of the finished labels were then washed using the modified AATCC wash test described above. Others were subjected to the AATCC wet crock test described above. The labels were found to exhibit good washfastness and good wet crocking properties.

EXAMPLE 40

Using the procedure of Example 39 above, 20 grams of a vinyl chloride-vinyl acetate copolymer (Geon 460X6, 52% TS, B. F. Goodrich) was thoroughly mixed with 50 grams of water in an air driven propeller-type mixer. The pH of the mixture was then adjusted to 8.5–9.5. Then, 50 grams of a carnauba wax and polymer dispersion (Jonwax 22) and 20 grams of an aqueous dispersion of a black sublimable dye (Foron Black SK) were added and thoroughly mixed with the other ingredients. The resulting ink composition was then coated onto a 1.2 mil untreated polyethylene carrier film (Philjo #685). Excess ink was metered off with a #10 Meyer bar. The dried ink composition comprised about 27 percent by weight of sublimable dye, about 34 percent by weight of resin components, and about 39 percent by weight of wax. Using a Markem Model 355 fabric label printer, a polyester fabric label tape (Markem #570) was printed with the carrier supported ink prepared above. The printed labels were then heated with a commercial heat seal unit (Pace Setter 500) for 2.0 to 2.5 seconds to sublime the dye into the fabric. The finished labels exhibited good washfastness when subjected to the modified AATCC wash test described above.

EXAMPLE 41

Using the procedure of Example 39 above, 100 grams of a rosin ester (Synthe-Copal #1204, Hercules, Inc.) was thoroughly mixed with 300 grams of toluene. To 52 grams of this mixture were added 40 grams of water, 5 grams of polyethylene glycol (Carbowax 6000, MW 570–630, Union Carbide) and 9 grams of a blue sublimable dye (Foron Blue RD-GLA, Sandoz) and all of the ingredients were thoroughly mixed. The ink composition was then coated onto a 1.2 mil untreated polyethylene carrier film (Philjo #685). Excess ink was metered off of the film with a #18 Meyer bar. The dried ink composition comprised about 33 percent by weight of sublimable dye, about 48 percent by weight of resin, and about 19 percent by weight of wax. The carrier supported ink produced good prints on a polyester fabric label tape (Markem #570) using a Markem 355 fabric label printer. The printed labels were heated in a heat seal unit (Pace Setter 500) for 10 seconds to sublime the dye into the fabric and then washed as above. The washed labels exhibited good washfastness.

EXAMPLE 42

Using the procedure of Example 39 above, 40 grams of methanol, 52 grams of a phenolic resin (BKS-2600, 52–56% TS, Union Carbide) and 5 grams of a polyethylene wax (Shamrock Chemical) were thoroughly mixed in an air-driven, propeller-type mixer. This mixture was then added with 9 grams of red sublimable dye (Foron Red GLA, Sandoz) to the stainless steel cylinders of a shot mill containing ceramic grinding media and all of the ingredients were thoroughly mixed by placing the cylinders in a Red Devil Paint Mixer. The ink composition was then coated onto a 1.2 mil untreated polyethylene film (Philjo #685). Excess ink was metered off with a ½18 Meyer bar. The dried ink composition comprised about 21 percent by weight of sublimable dye, about 67 percent by weight of resin, and about 12 percent by weight of wax. The carrier supported ink produced good prints on a polyester fabric label tape (Markem #570) using a Markem Model 355 fabric label printer. The printed labels were heated in a heat seal unit (Pace Setter 500) for 10 seconds to sublime the dye into the fabric and then washed as above. The washed labels exhibited good washfastness.

EXAMPLE 43

Using the procedure of Example 39 above, 100 grams of water was thoroughly mixed with 35 grams of a polyurethane emulsion resin (Solucote 49-116AX, 35% TS, Soluol Chemical). Following adjustment of the pH to 8–9, 100 grams of a carnauba wax and polymer dispersion (Jonwax 22), 35 grams of a black sublimable dye (Foron Black SK), and 2.7 grams of a surfactant (Troykyd Anti Crater, Troy Chemical Co.) were added to the mixture which was then thoroughly mixed. The ink composition was then coated onto a 1.2 mil untreated polyethylene film (Philjo #685). Excess ink was metered off with a #10 Meyer bar. The dried ink composition comprised about 26 percent by weight of sublimable dye, about 26 percent by weight of the resin components, about 44 percent by weight of wax, and about 4 percent by weight of anticrater. The carrier supported ink produced good prints on a polyester fabric label tape (Markem 190 570) using a Markem Model 355 fabric label printer. The printed labels were heated in a heat seal unit (Pace Setter 500) for 10 seconds to sublime the dye into the fabric.

EXAMPLE 44

The black carrier supported ink prepared with the polyethylene carrier film in Example 9 above was used in a Markem Model 355 fabric label printer to print on a polyester fabric label tape (Markem #570). The printed fabric tape was then passed in front of and exposed to a xenon flash lamp (EG&G #FXQ-277-4) using an apparatus similar to that shown in FIG. 3. The flash lamp was operated at a supply potential of 1.5 Kilovolts, provided by a 300 microfarad capacitor discharging over a cycle time of 0.25 second. The total energy produced by the lamp was 42 joules per cycle and the energy density at the print was 2.3 joules/cm$^2$. The xenon flash caused the dye in the ink to sublime into the fabric. The finished labels were then washed using the modified AATCC wash test described above. The labels were found to exhibit good washfastness.

EXAMPLE 45

Following the procedure of Example 44 above, a polyester fabric label tape (Markem #570) was first printed with the blue carrier supported ink prepared in Example 14 using a Markem Model 355 fabric label printer to provide a blue background. The blue background was then overprinted with an image using the black carrier supported ink on the polyethylene carrier prepared in Example 9 above. The printed fabric tape was then passed in front of and exposed to a xenon flash lamp (EG&G #FXQ-277-4) for 0.25 second at an energy density of 2.3 joules/cm$^2$ causing the dye in the ink to sublime into the fabric. The finished labels were then subjected to the modified AATCC wash test as described above and were found to exhibit good washfastness.

EXAMPLE 46

Into an air-driven, propeller-type mixer was added 3000 ml. of methanol and 250 grams of ethyl cellulose and thoroughly mixed. This mixture was then added to a ball mill with 175 grams of #120 carnauba wax and mixed for 4 hours. After removing the mixture, the ball mill was rinsed with 400 ml. of methanol. Then, 300 ml. of methanol, 50 ml. of the mixture prepared above, and 30 grams of a black sublimable dye (Foron Black SK) were added to the ball mill and mixed for 3 hours. The ink composition was then coated onto a 1.5 mil treated polyethylene carrier film (Philjo #606) and the excess was metered off using a #10 Meyer bar. The dried ink composition comprised about 91 percent by weight of sublimable dye, about 5 percent by weight of resin, and about 4 percent by weight of wax. Using a Markem Model 255 fabric label printer, the carrier supported ink was found to produce good prints on a polyester fabric label tape (Markem #570).

What is claimed is:

1. A process for forming a permanent, abrasion and chemical resistant image on a fabric or plastic substrate comprising:

(a) providing a printing matrix having raised portions in the shape of the image to be printed on the substrate, (b) providing a carrier supported ink comprising (1) a uniform coating of an ink composition comprising (i) from about 2 to about 91 percent by weight of a sublimable dye, (ii) from about 2 to about 67 percent by weight of a resin, and (iii) from about 4 to about 45 percent by weight of a wax, wherein the dye, resin and wax and the amounts thereof are selected so that the ink composition forms a discontinuous film on the carrier surface that will fracture along the edges of the areas where the matrix contacts the carrier sheet and that will completely release from the carrier sheet within the fracture lines in the shape of the image defined by the raised portions of the printing matrix, (2) a carrier sheet for supporting said coating on one surface thereof, said carrier sheet comprising a material (i) which is compatible with said ink composition, and (ii) which has a thickness and deformability which permits the carrier sheet to conform to the raised portions on the printing matrix by stretching the carrier sheet over the raised portions and which further permits the pressure applied to the uncoated side of the carrier sheet to cause the ink composition to completely release from the carrier sheet in the shape of the image defined by the raised portions of the printing matrix, wherein said carrier sheet is selected from the group consisting of polyethylene, polypropylene, polyester, polyamide and cellophane films, and has a thickness of from about 0.25 mil to about 2.5 mils, (c) disposing the carrier supported ink adjacent to the printing matrix such that the uncoated surface of the carrier sheet faces the printing matrix, (d) providing a fabric or plastic film substrate having a surface through which said sublimable dye can diffuse, (e) disposing the substrate such that the surface thereof faces the coated surface of the carrier sheet, (f) applying pressure between said printing matrix and said substrate to cause the printing matrix to contact the uncoated surface of the carrier sheet and to cause the coated surface of the carrier sheet to contact the substrate surface, said pressure being applied under conditions sufficient to cause the ink composition to completely transfer from the carrier sheet to the substrate surface in the shape of the image defined by the raised portions of the printing matrix, but insufficient to cause the dye in the ink composition to sublime or vaporize and diffuse into the substrate surface, (g) removing the carrier sheet from contact with the printed substrate surface following the application of pressure between the printing matrix and the substrate, and (h) heating the ink composition which has been transferred to the substrate surface, said heating occurring under conditions of temperature, pressure and time sufficient to cause the dye therein to sublime or vaporize and diffuse into the substrate surface.

2. The process of claims 1 wherein the dye sublimes or vaporizes at a temperature above about 140° C. at atmospheric pressure.

3. The process of claim 2 wherein the dye sublimes or vaporizes at a temperature between about 160° C. and about 205° C. at atmospheric pressure.

4. The process of claims 1 wherein the substrate is a fabric selected from the group consisting of polyester, nylon, acetate, blends of polyester, nylon or acetate containing cotton or wool, and cotton or wool that has been treated to accept a sublimable dye.

5. The process of claims 1 wherein the substrate is a plastic film selected from the group consisting of polyester and nylon.

6. The process of claim 1 wherein the carrier sheet has a thickness of from about 0.5 mil to about 1.5 mils.

7. The process of claims 1 wherein the ink composition which has been transferred to the substrate surface is heated by conduction.

8. The process of claim 7 wherein the ink composition which has been transferred to the substrate surface is heated to a temperature between about 140° C. and about 224° C. for a time period from about 2 seconds to about 10 seconds.

9. The process of claims 1 wherein the ink composition which has been transferred to the substrate surface is heated by convection.

10. The process of claims 1 wherein the ink composition which has been transferred to the substrate surface is heated by radiation.

11. The process of claim 10 wherein the source of radiant heat is an infrared lamp.

12. The process of claim 10 wherein the source of radiant heat is a laser.

13. The process of claim 10 wherein the source of radiant heat is a gas discharge lamp.

14. The process of claim 13 wherein the source of radiant heat is a xenon flash lamp.

15. A process for forming a permanent abrasion and chemical resistant image on a fabric or plastic substrate comprising:

(a) providing a printing matrix having raised portions in the shape of the image to be printed on the substrate, (b) heating said printing matrix to a predetermined temperature, (c) providing a carrier supported ink comprising (1) a uniform coating of an ink composition comprising (i) from about 2 to about 91 percent by weight of a dye which is sublimable under predetermined conditions of temperature, pressure and time, (ii) from about 2 to about 67 percent by weight of a resin which binds the ink composition to the surface of the carrier prior to application of heat and pressure between the printing matrix and the substrate, which permits complete transfer of the ink composition during such application of heat and pressure, which subsequently binds the ink composition to the substrate, but which does not hinder sublimation or vaporization of the dye during application of heat and pressure to the ink composition on the substrate, and (iii) from about 4 to about 45 percent by weight of a wax, wherein the dye, resin and wax and the amounts thereof are selected so that the ink composition forms a discontinuous film on the carrier surface that will fracture along the edges of the areas where the matrix contacts the carrier sheet and that will completely release from the carrier sheet within the fracture lines in the shape of the image defined by the raised portions of the printing matrix, and (2) a carrier sheet for supporting said coating on one surface thereof, said carrier sheet comprising a material (i) which is compatible with said ink composition, and (ii) which has a thickness, deformability and thermal conductivity which permits the carrier sheet to conform to the raised portions on the printing matrix by stretching the carrier sheet over the raised portions and which further permits the heat and pressure applied to the uncoated side of the carrier sheet to melt or soften the ink composition so that the coating will completely release from the carrier sheet in the shape of the image defined by the raised portions of the printing matrix, wherein said carrier sheet is selected from the group consisting of polyethylene, polypropylene, polyester, polyamide and cellophane films, and has a thickness of from about 0.25 mil to about 2.5 mils, (d) disposing the carrier supported ink adjacent to the heated printing matrix such that the uncoated surface of the carrier sheet faces the printing matrix, (e) providing a fabric or plastic film substrate having a surface through which said sublimable dye can diffuse, (f) disposing the substrate such that said surface thereof faces the coated surface of the carrier sheet, (g) applying pressure between said heated printing matrix and said substrate to cause the printing matrix to contact the uncoated surface of the carrier sheet and to cause the coated surface of the carrier sheet to contact the substrate surface, said pressure being applied in an amount and for a time sufficient, and the temperature of said heated printing matrix being sufficient, to cause the ink composition to completely transfer from the carrier sheet to the substrate surface in the shape of the image defined by the raised portions of the printing matrix, but the combination of said pressure, time and temperature being insufficient to cause the dye in the ink composition to sublime or vaporize and diffuse into the substrate surface, (h) removing the carrier sheet from contact with the printed substrate surface following the application of pressure between the heated printing matrix and the substrate, and (i) heating the ink composition which has been transferred to the substrate surface to a sufficient temperature under sufficient pressure and for a sufficient amount of time to cause the dye therein to sublime or vaporize and then diffuse into the substrate surface.

16. The process of claims 15 wherein the dye sublimes or vaporizes at a temperature above about 140° C. at atmospheric pressure.

17. The process of claim 16 wherein the dye sublimes or vaporizes at a temperature between about 160° C. and about 205° C. at atmospheric pressure.

18. The process of claims 15 wherein the substrate is a fabric selected from the group consisting of polyester, nylon, acetate, blends of polyester, nylon or acetate containing cotton or wool, and cotton or wool that has been treated to accept a sublimable dye.

19. The process of claims 15 wherein the substrate is a plastic film selected from the group consisting of polyester and nylon.

20. The process of claim 15 wherein the carrier sheet has a thickness of from about 0.5 mil to about 1.5 mils.

21. The process of claims 15 wherein the printing matrix is maintained at a temperature in the range of about 52° C. to about 205° C., the pressure applied between the matrix and the substrate is in the range of about 100 psi to about 1000 psi, and the printing matrix, carrier supported ink and substrate surface are contacted for a period of time from about 0.1 second to about 1 second.

22. The process of claims 15 wherein the ink composition which has been transferred to the substrate surface is heated by conduction.

23. The process of claim 22 wherein the ink composition which has been transferred to the substrate surface is heated to a temperature between about 140° C. and about 224° C. for a time period from about 2 seconds to about 10 seconds.

24. The process of claims 15 wherein the ink composition which has been transferred to the substrate surface is heated by convection.

25. The process of claims 15 wherein the ink composition which has been transferred to the substrate surface is heated by radiation.

26. The process of claim 25 wherein the source of radiant heat is an infrared lamp.

27. The process of claim 25 wherein the source of radiant heat is a laser.

28. The process of claim 25 wherein the source of radiant heat is a gas discharge lamp.

29. The process of claim 28 wherein the source of radiant heat is a xenon flash lamp.

* * * * *